US005335676A

United States Patent [19]

O'Brien

[11] Patent Number: 5,335,676

[45] Date of Patent: Aug. 9, 1994

[54] SLIDING CABLE MASSAGE TABLE

[76] Inventor: Lynwood O'Brien, 5381 Old San Jose Rd., Soquel, Calif. 95073

[21] Appl. No.: 106,298

[22] Filed: Aug. 13, 1993

[51] Int. Cl.[5] ..... A61G 15/00; A47B 3/00

[52] U.S. Cl. ..... 128/845; 108/128; 5/620

[58] Field of Search ..... 108/115, 116, 123, 128, 108/130, 131, 132, 160; 248/166; 5/620, 627; 606/240, 243; 128/33, 845, 870

[56] References Cited

U.S. PATENT DOCUMENTS

| | | | |
|---|---|---|---|
| 2,326,461 | 8/1943 | Howe . | |
| 3,037,215 | 6/1962 | Pile | 5/620 |
| 3,067,975 | 12/1962 | Wilcox | 108/116 |
| 3,357,729 | 12/1967 | Krueger . | |
| 3,359,576 | 12/1967 | Pile | 5/620 |
| 4,333,638 | 6/1982 | Gillotti . | |
| 4,354,437 | 10/1982 | Logan | 108/128 |
| 4,927,123 | 5/1990 | Schwerdt . | |
| 4,927,128 | 5/1990 | O'Brian . | |

FOREIGN PATENT DOCUMENTS

| | | | |
|---|---|---|---|
| 839614 | 5/1952 | Fed. Rep. of Germany | 108/115 |

*Primary Examiner*—Robert A. Hafer
*Assistant Examiner*—Michael O'Neill
*Attorney, Agent, or Firm*—Jeffrey A. Hall

[57] ABSTRACT

A sliding cable massage for use in massage and other therapeutic applications comprising a table top composed of a pair of abutting top sections having a frame rail attached thereto and having a truss centrally positioned and hingedly connected to the table top sections. Four circular members are secured in the corners of the table top. A pair of legs sets, each leg set comprising a pair of legs, a cross tube, a brace tube, and a telescoping internal height adjustment tube operably secured within each leg. A first set of four cables are operably secured to the truss at one end and to the cross tube at another end and have a middle portion operably engaged to the circular member. A second set of four cables is provided where each cable is secured at one end to the frame rail at a first end and a second end of each cable secured to a leg set at the cross tube.

14 Claims, 2 Drawing Sheets

SLIDING CABLE MASSAGE TABLE

BACKGROUND OF THE INVENTION

1. Field of Invention

This invention relates to massage tables, and more particularly to massage tables for use in physical therapy, massage, and other related body work activities.

2. Description of the Related Art

In therapeutic massage and other related body work, most practitioners prefer to use a table to support the person who is being massaged at a level which is convenient and comfortable to work at. It is highly desirable to have such a table which provides a strong working surface, is lightweight, adjustable, and easy to set up an break down for storage.

Heretofore a wide variety of tables have been proposed and implemented for massage and other therapeutic body work.

U.S. Pat. No. 4,927,128, issued to the present inventor on May 22, 1990 disclosed a sliding leg bodywork table including a channel system which provided support for the table legs and rotatable diagonal braces which extended from a cross tube for connecting each leg pair to the table surface. A system of wire ropes supported the central hinged end of the table top sections and operated in conjunction with diagonal braces for locking of the legs in an operational position.

U.S. Pat. No. 4,333,638 to Gilloti discloses a table with a truss suspension system having legs hinge from the ends of the table and diagonal braces extending from the center of the table to attach onto the table legs. The truss system consisted of a cord member of wire rope or flexible material attached to the lower end of the legs and extended the full length of the table parallel to the table surface. Users regarded this type of table as unsatisfactory because the position of the cable interfered with the movement of the user and required the user to connect and disconnect the diagonal braces on one or both ends on setting up or collapsing the table.

Another type of folding table is disclosed in U.S. Pat. No. 3,357,729 to Krueger, consisting of a collapsible table with strap-like brace members having folding legs at each end. This type of table did not have a support cable system attached to the legs, nor did it provide a strong working platform, and tended to be noisy when rocking forces were applied thereto. Also this type of table required some skill and training on the part of its users to set up and collapse, and provided limited means to adjust height dimension of the working surface.

A different genre of folding support structures is disclosed in U.S. Pat. No. 2,326,461 to Howe. Such table consisted of a plurality of braces hinged to support legs, and was foldable into a carrying case. This type of support structure relates to tables where the act of folding together the hinged top portion causes collapsing or folding of the support legs. Such table was not adjustable, stable, or suitable for massage or other body work application. Most users, therefore, would find it desirable to have a massage table that provides a strong working platform that is quiet even when rocking forces are applied, adjustable, lightweight, easy to set up, collapse, store, and inexpensive to manufacture.

Accordingly, it is the primary object of this invention to provide an improved sliding cable massage table which is very lightweight and portable, provides a very stable working surface for massage and other therapeutic bodywork, which has a very reliable self-opening and closing leg mechanism with a built-in locking capability, and which is very inexpensive to manufacture.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

SUMMARY OF THE INVENTION

To achieve the foregoing objects, and in accordance with the purposes of the invention as embodied and broadly described herein, a portable massage table is provided, comprising: a rectangular table top composed of a pair of abutting table tops sections hingedly connected to one another, each of said pair of abutting table top sections having a perimeter frame rail integral with each of said table tops sections, and a pair of inner corners and a pair of outer corners; a centrally positioned truss having a first end and a second end, said second end being hingedly secured to said pair of abutting rectangular table top sections; a plurality of circular members, each circular member being positioned in one of said outer corners of said pair of abutting rectangular table top sections; a pair of leg sets, each leg set comprising a pair of legs, a cross tube, a brace tube, and a telescoping internal height adjustment tube operably secured within each leg; a plurality of first cables, each cable having a first end and a second end, said first end of each of said first cables is secured to said first end of said truss, said second end of each of said first cables is secured to said cross tube, and a middle portion of each of said first cables is slideably secured to one of said plurality of circular members; and a plurality of second cables, each of said plurality of second cables having a first end and a second end, said first end of each of said plurality of second cables is secured to said perimeter frame rail, and said second end of each of said cables is secured to a leg set at a cross tube.

In accordance with the present invention there is also provided a sliding cable massage table, for use in massage and other therapeutic applications, comprising: a table top composed of a pair of abutting top sections hingedly connected to one another, each of said pair of abutting table top sections having a perimeter frame rail integral with each of said table top sections, and a pair of inner corners and a pair of outer corners a centrally positioned truss having a first end and a second end, said second end being hingedly secured to said pair of abutting top sections; four circular members, each circular member being positioned in one of said outer corners of said pair of abutting table top sections; a pair of legs sets, each leg set comprising a pair of legs, a cross tube, a brace tube, and a telescoping internal height adjustment tube operably secured within each leg; a set of four first cables, each of said set of first cables having a first end and a second end, said first end of each of said first cables is secured to said first end of said truss, said second end of each of said first cables is secured to said cross tube, and a middle portion of each of said first cables is slideably secured to one of said circular members; and a set of four second cables, each of said set of second cables having a first end and a second end, said first end of each of said second cables is secured to said perimeter frame rail, and said second end of each of said second cables is secured to a leg set at said cross tube.

BRIEF DESCRIPTION OF THE DRAWINGS

The accompanying drawings, which are incorporated in and constitute a part of the specification, illustrate a preferred embodiment of the invention and, together with a general description given above and the detailed description of the preferred embodiment given below, serve to explain the principles of the invention.

DETAILED DESCRIPTION OF THE PREFERRED EMBODIMENTS

Reference will now be made in detail to the present preferred embodiments of the invention as illustrated in the accompanying drawings.

In accordance with the present invention, there is provided a portable massage table, comprising: a rectangular table top composed of a pair of abutting table top sections hingedly connected to one another, each of said pair of abutting table top section having a perimeter frame rail integral with each of said table tops sections, and a pair of inner corners and a pair of outer corners; a centrally positioned truss having a first end and a second end, said second end being hingedly secured to said pair of abutting rectangular table top sections; a plurality of circular members, each circular member being positioned in one of said outer corners of said pair of abutting rectangular table top sections; a pair of leg sets, each leg set comprising a pair of legs, a cross tube, a brace tube, and a telescoping internal height adjustment tube operably secured within each leg; a plurality of first cables, each cable having a first end and a second end, said first end of each of said first cables is secured to said first end of said truss, said second end of each of said first cables is secured to said cross tube, and a middle portion of each of said first cables is slideably secured to one of said plurality of circular members; and a plurality of second cables, each of said plurality of second cables having a first end and a second end, said first end of each of said plurality of second cables is secured to said perimeter frame rail and said second end of each of said cables is secured to a leg set at a cross tube.

Figure 1:
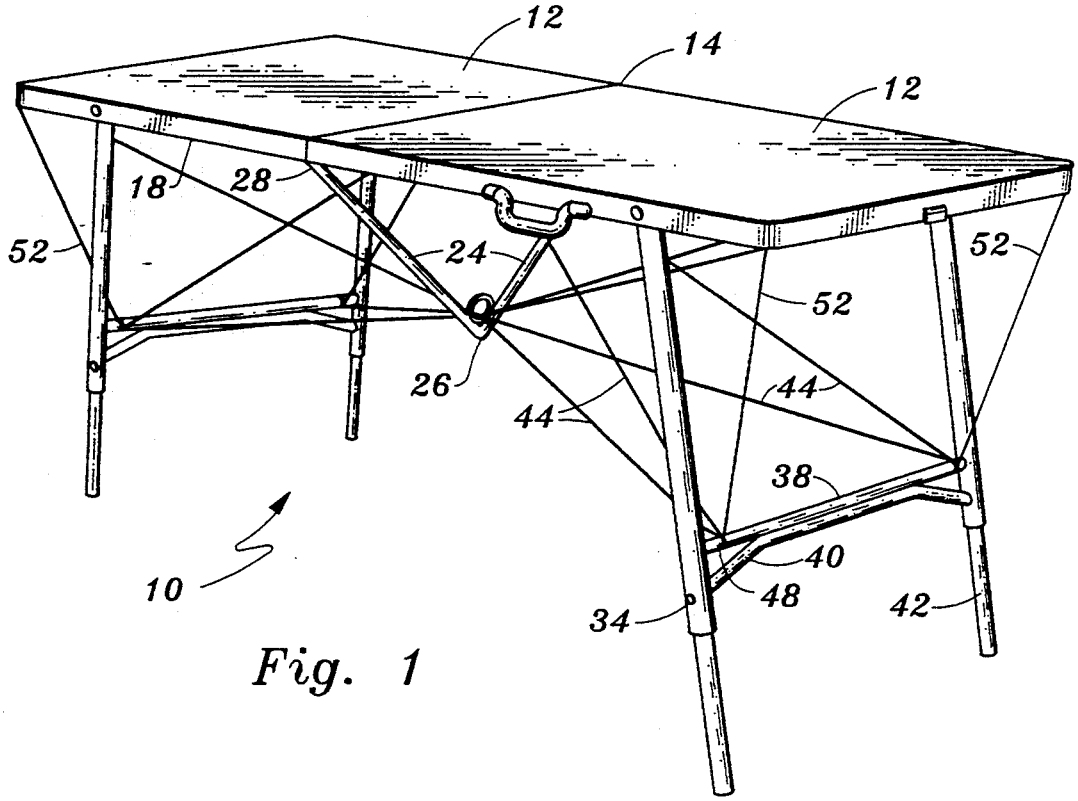
FIG. 1 shows a front perspective view of a sliding cable massage table, according to the invention.

In FIG. 1 the portable massage table 10 is shown comprising a rectangular table top 12 composed of a pair of abutting table top section 14 which are preferably hingedly connected by hinge 16. Each of said pair of abutting table top sections 14 have a perimeter frame rail 18 which is preferably provided integral with each of the table top sections but may be otherwise, for example, attached with screws, bolts, nails or the like. Each table top section 14 has a pair of inner corners 20 and a pair of outer corners 22. The table top sections 14 are preferably composed of wood, however, metal, plastics, or other durable resilient material may also be used. Table top sections 14 are preferably covered with a cushion and upholstery for additional comfort and aesthetics.

A centrally positioned truss 24 is preferably hingedly secured to the table top sections by hinge 30, and has a first end and a secured end. Truss 24 is preferably composed of metal, however, other durable material may be used, such as wood, plastic, hardened, rubber, or the like. Truss 24 may be triangular or may be provided as two central members positioned one on each side of hinge 16.

A plurality of circular member 32 are positioned and secured in each of said outer corners 22 of the pair of abutting rectangular table top sections 14. The circular members preferably comprise four sheaves 33, one in each of the outer corners 22 of massage table 10. Sheaves 33 may be substituted by four wheels, four pulleys, four tubes, or any other circular member which can slideably receive and secure a cable thereon.

Figure 2:
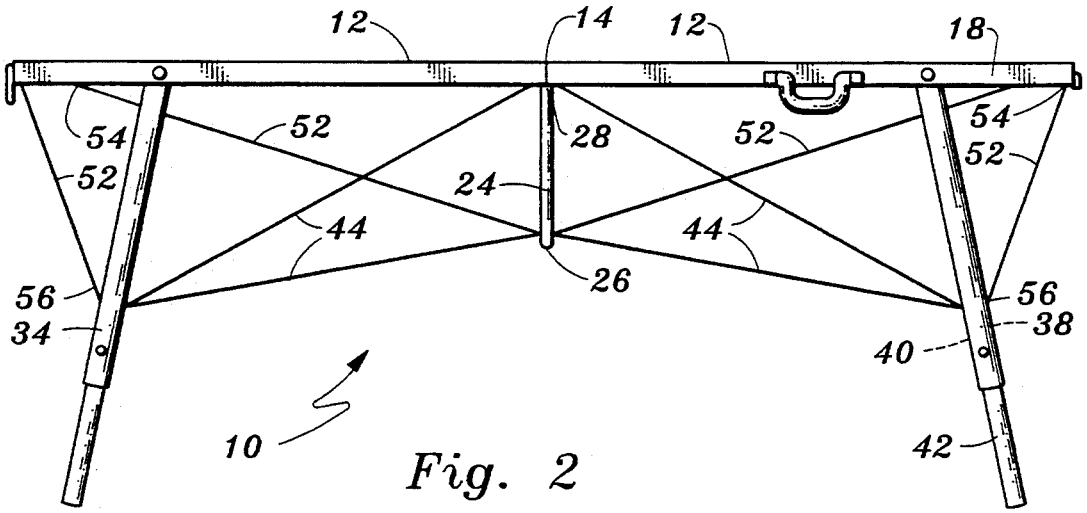
FIG. 2 shows a side view of such table.
Figure 3:
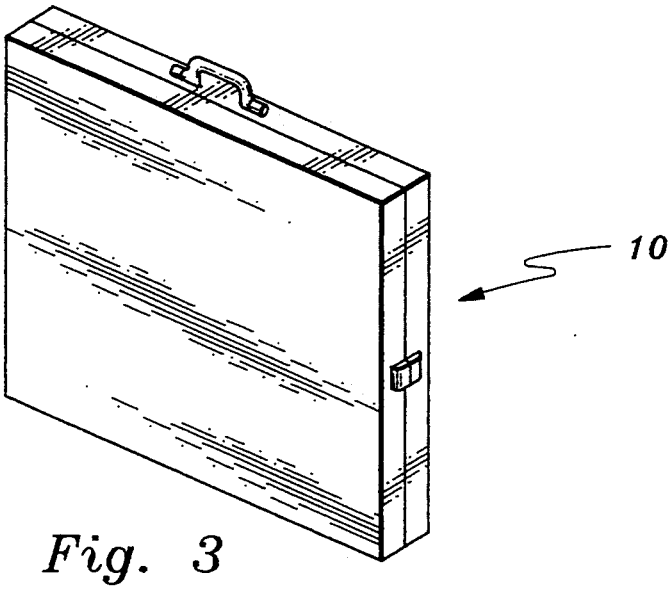
FIG. 3 shows a perspective view of such table in a folded, transportable position.
Figure 4:
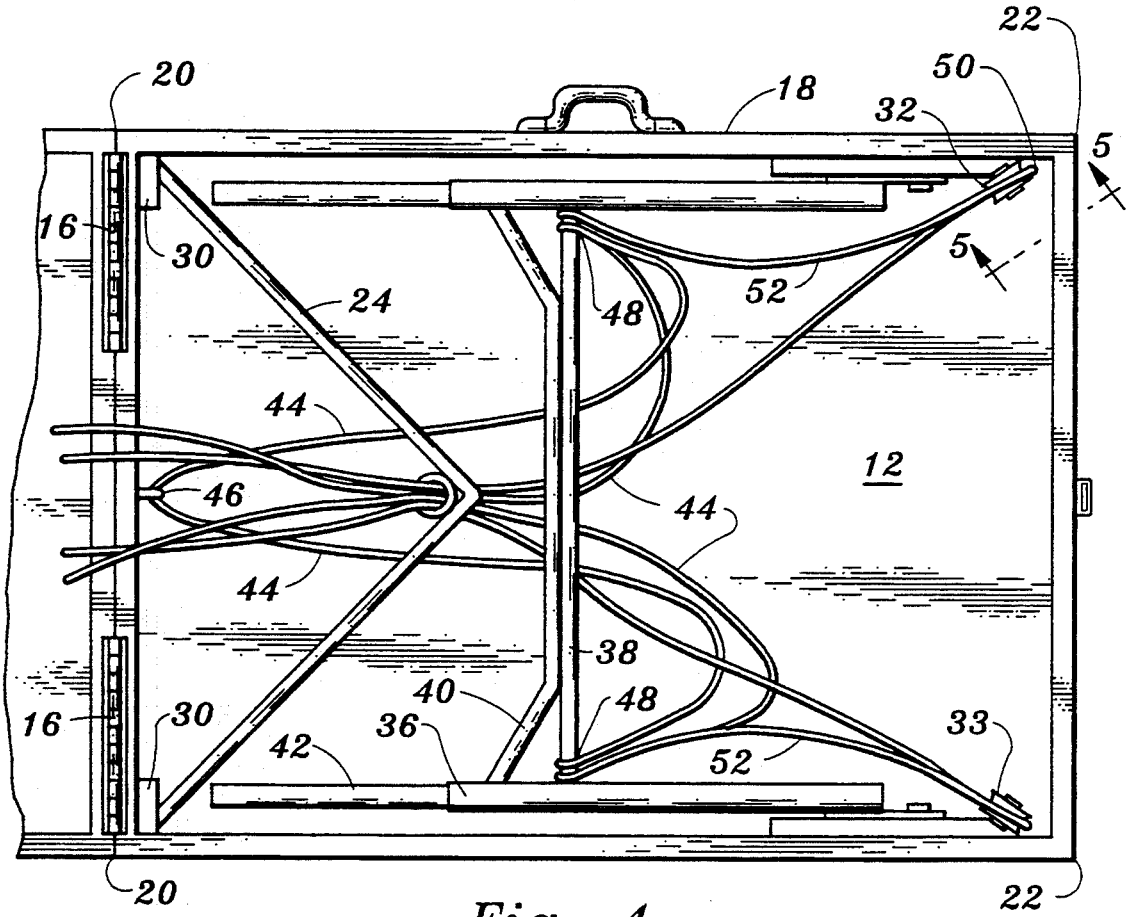
FIG. 4 shows a perspective view of the undersurface of such table showing the legs and braces in a folded position.
Figure 5:
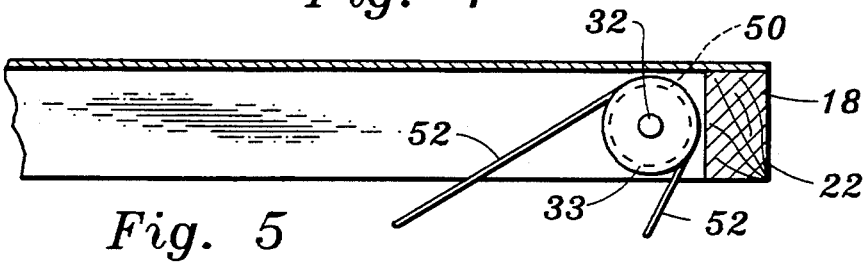
FIG. 5 shows a enlarged view of a wheel member with cables attached, according to the invention.

A pair of legs sets 34 are secured to table top 12 by mechanical fastening means such as screws, bolts, nuts, adhesives, or receiving grooves, or a combination of the above. Each leg set 34 comprises a pair of legs 36, a cross tube 38 secured between each pair of legs, and a brace tube 40 secured and attached to each leg pair by screws, bolts, welding, adhesives, or other mechanical fasteners well known in the art. Each leg has a telescoping inner height adjustment tube 42 operably secured therein. Brace tube 40 is preferably configured as an abbreviated C-shaped member as best seen in FIGS. 1, 2, 4.

A self opening and closing leg mechanism with built-in automatic locking capability is provided by a plurality of first cables 44, each of said first cables 44 has a first end 46 and a second end 48. In the preferred embodiment there are four first cables 44. Each of said first cables 44 is secured to a first end 46 of said truss 24 by means of a loop fixture. screws, knot, blot, or other mechanical means well known the art. The second end 48 of each of said first cables 44 is secured to said cross tube 38 by a loop fastener, screws, bolts, rivet, or any other well known fastening means. First cables 44 are preferably composed of stranded wire, however, other durable, resilient, and strong wire, cable or rope may be used satisfactorily.

A plurality of second cables 52, four in the preferred embodiment are provided. Each of said second cables has a first end 54 and a second end 56. The first end 54 of each of said plurality of second cables 52 is secured to said cross tube 38 by hook, screws, bolts, or other mechanical fastening means, and said secured end of each of said plurality of second cables is secured to a leg set 34 at or near the attachment point of cross tube 38.

In another embodiment of the invention the sliding cable massage table 10 comprises a table top 12 composed of a pair of abutting top sections 14, hingedly connected to one another by hinge 16. Each member of said pair of table top sections has a perimeter frame rail 18 integral with each of said table tops sections and a pair of inner corners 20 and a pair of outer corners 22. The table may be rectangularly configured, square, oval, or otherwise. Truss 24 with first end 26 and second end 28 is secured to the table top 14 by a hinge 30. Four circular members 32, which may be sheaves, wheels, pulleys, tubes, or the like are firmly secured in each or the outer corners 22 of the table top. Each pair of leg sets 34 comprise a pair of legs 36, cross tube 38, a substantially C-shaped brace tube, and the telescoping internal height adjustment tube 42 with in each leg for adjusting the height of the leg by either sliding height adjustment tube 42 inward or outward from a leg. Four first cables 44 each having a first end 46 and a second 48 are secured to the truss. The first end 46 of each cable 44 is secured to first end 28 of truss 24 by a loop fastener, a knot, bolt, leg by either sliding height adjustment tube 42 inward or outward from a leg. Four first cables 44 each having a first end 46 and a second 48 are secured to the truss. The first end 46 of each cable 44 is secured to first end 28 of truss 24 by a loop fastener, a knot, bolt, rivet, or other mechanical fastening means, and the second end 48 of each of said first cables is secured to cross tube 38. The middle portion 50 of each of said first cables is slideably looped around each one of the circular members 32. A set of four second cables having a first end 54 and a second end 56 are secured at first end 54 to the perimeter frame rail and the second end of each of said second cables 52 is secured to a leg set 34 at cross tube 38. The first set of cables 44 and the second set of cables 52 may be composed any strong, durable, resilient material such as metal, synthetics, stranded wire, or the like.

In operation and use the sliding cable massage table 10 of the present invention provides a working surface for massage and other therapeutic body work which is lightweight and portable, which provides a self-opening and closing leg mechanism with automatic leg locking, which is very stable, strong, and easy to use and operate, which is aesthetically pleasing, and which may be manufactured inexpensively. The massage table 10 may be easily opened or closed by simply opening table top sections 14 away from one another, or if the user wishes to close the table by simply folding table top sections 14 together. The sliding cable system in combination with truss 24, circular members 32, and leg sets 34, provide support for the central hinged area of table top 12. Leg sets 34 provide support for table top 12 and connecting points for the cable sets. This novel combination allows table 10 to easily and quickly moved back and forth in two primary modes; the storage or the transport mode, where the table sections are folded together and leg sets 34 are folded against the table top; and the use or operating mode where the table sections 14 are opened and abutting, providing a working platform with the legs opened and held tightly in a position providing support and stability for the table top 12.

The preferred operation of table 10 is to place table 10 on its side and open table top sections 14. As sections 14 become partially separated slack is taken up in the first set of cables 44, with cables 44 rolling around sheave 33 which transfers a pulling and opening force to leg sets 34 at leg cross tubes 38. This movement continues until leg sets 34 are fully opened or extended, and in this position are angled slightly outward. Cables 44 simultaneously opens pulls truss 24 open and positions it beneath and perpendicular to table top sections 14. In the fully opened position opposing tension between cables 44 and cables 52 provide a static holding function of legs sets 34. In this position the central area of table sections 14 is support by truss 24 and cables 44. Weight applied to table top 12 is transfered through truss 24 into cables 44 and around sheaves 33 thereby providing a pulling force on leg set 34 at cross tubes 38 and thereby also pulling on and tightening cables 52.

To close massage table 10 and proceed from the operational mode to the storage mode, table 10 is preferably turned on it's side and with no weight on table top 12, leg sets 34 are pulled towards the center of table top sections 14. Hinged truss 24 is automatically folded within and onto the bottom of the table to sections 14. As leg sets 34 are closed into the table top a pulling force is transferred from leg sets 34 through cross tube 38 and through cables 44 around sheave 33. Such pulling force provides the majority of the closing action for the table top sections 14 and pulls truss 24 evenly onto the closing table top sections. After leg sets 34 are fully closed and folded against the table top sections 14, the remaining opening in the between the top sections 14 is closed.

Additional advantages and modifications will readily occur to those skilled in the art. The invention in its broader aspects is, therefore, not limited to the specific details, representative apparatus and illustrative examples shown and described. Accordingly departures may be made from such details without departing from the spirit or scope of the applicant's inventive concept.

What is claimed is:

1. A portable massage table, comprising:

a rectangular table top composed of a pair of abutting table top sections hingedly connected to one another, each of said pair of abutting table top sections having a perimeter frame rail integral with each of said table top sections, and a pair of inner comers and a pair of outer corners;

a centrally positioned truss having a first end and a second end, said second end being hingedly secured to said pair of abutting rectangular table top sections;

a plurality of circular members, each circular member being positioned in one of said outer corners of said pair of abutting rectangular table top sections;

a pair of leg sets, each leg set comprising a pair of legs, a cross tube, a brace tube, and a telescoping internal height adjustment tube operably secured within each leg;

a plurality of first cables, each cable having a first end and a second end, said first end of each of said first cables is secured to said first end of said truss, said second end of each of said first cables is secured to said cross tube, and a middle portion of each of said first cables is slideably secured to one of said plurality of circular members; and a plurality of second cables, each of said plurality of second cables having a first end and a second end, said first end of each of said plurality of second cables is secured to said perimeter frame rail, and said second end of each of said cables is secured to a cross tube at a leg set.

2. The portable massage table of claim 1 wherein said plurality of circular members comprise four sheaves.

3. The portable massage table of claim 1 wherein of said plurality of circular members comprise four wheels.

4. The portable massage table of claim 1 wherein said plurality of circular members comprise four tubes.

5. The portable massage table of claim 1 wherein said plurality of circular members comprise four pulleys.

6. The portable massage table of claim 1 wherein said plurality of first cables are composed of stranded wire.

7. The portable massage table of claim 1 wherein said plurality of second cables are composed of stranded wire.

8. A sliding cable massage table, for use in massage and other therapeutic applications, comprising:

a table top composed of a pair of abutting top sections hingedly connected to one another, each of said pair of abutting table top sections having a perimeter frame rail integral with each of said table top sections, and a pair of inner corners and a pair of outer corners;

a centrally positioned truss having a first end and a second end, said second end being hingedly secured to said pair of abutting top sections;

four circular members, each circular member being positioned in one of said outer corners of said pair of abutting table tops sections;

a pair of leg sets, each leg set comprising a pair of legs, a cross tube, a brace tube, and a telescoping internal height adjustment tube operably secured within each leg;

a set of four first cables, each of said set of first cables having a first end and a second end, said first end of each of said first cables is secured to said first end of said truss, said second end of each of said first cables is secured to said cross tube, and a middle portions of each of said first cables is slideably secured to one of said circular members; and a set of four second cables, each of said set of second cables having a first end and a second end, said first end of each of said second cables is secured to said perimeter frame rail, and said second end of each of said second cables is secured to a cross tube at a leg set.

9. The sliding cable massage table of claim 8 wherein said four circular members are sheaves.

10. The sliding cable massage table of claim 8 wherein said four circular members are wheels.

11. The sliding cable massage table of claim 8 wherein said circular members are tubes.

12. The sliding cable massage table of claim 8 wherein said circular members are pulleys.

13. The sliding cable massage table of claim 8 wherein said set of four first cables are composed of stranded wire.

14. The sliding cable massage table of claim 8 wherein said set of four second cables are composed of stranded wire.

* * * * *